United States Patent [19]

Wallch

[11] 4,124,951

[45] Nov. 14, 1978

[54] MAGNETIC PARTICLE TOY WITH MAGNETIC RETAINING MEANS

[76] Inventor: Alfred H. Wallch, c/o Walco Toy Co., Inc., 38 W. 37th St., New York, N.Y. 10018

[21] Appl. No.: 751,667

[22] Filed: Dec. 17, 1976

[51] Int. Cl.[2] ..... A63H 33/26

[52] U.S. Cl. ..... 46/238; 46/240

[58] Field of Search ..... 46/236–240; 273/1 M

[56] References Cited

U.S. PATENT DOCUMENTS

| | | | |
|---|---|---|---|
| 1,549,197 | 8/1925 | Hanback | 46/237 |
| 2,590,002 | 3/1952 | Frazier | 46/239 |
| 2,853,830 | 9/1958 | Herzog | 46/239 |
| 3,568,360 | 3/1971 | Wallach | 46/236 |
| 3,883,988 | 5/1975 | Fields | 46/239 |

*Primary Examiner*—Louis G. Mancene
*Assistant Examiner*—Robert F. Cutting
*Attorney, Agent, or Firm*—John M. Montstream

[57] ABSTRACT

The dislosed invention is a toy of the type having a base or picture plate, which may have a partial picture thereon, over which magnetic particles are moved by a magnet or stylus over the base plate and deposit the particles thereon to decorate a partial picture or create an entire picture. The toy has a magnetic plate also and one plate is movable towards and away from the other so that when the plates are separated the particles are away from all or most of the influence of the magnetic plate and are more easily moved. When a picture has been completed the movable plate is moved adjacent to or in contact with the other plate so that magnetic attraction retains the particles in place on the base plate. In addition the toy in a more advanced form enables two or more colors to be used with pellets of different dimensions with each dimension or diameter of pellet being of one color and another diameter being of another color and the sizes and hence colors being separable from each other after use by screening.

18 Claims, 7 Drawing Figures

MAGNETIC PARTICLE TOY WITH MAGNETIC RETAINING MEANS

The invention herein presents improvements in the magnetic toy disclosed in my earlier U.S. Pat. No. 3,568,360 in which magnetizable particles are moved by a magnet to and over a base plate either to create a picture thereon or embellish a picture thereon. In that toy a magnetic plate is fixed adjacent to the base plate so that the stylus or magnet picks up and moves the particles against the attraction of the magnetic plate. By moving the magnetic plate away from the base plate or the latter away from the magnetic plate the stylus is more effective in moving the particles and when it is desired to magnetically anchor or retain the particles in place, the movable plate is moved into contact with or adjacent to the other plate. In addition the interest in a toy of this sort is enhanced if selective color can be introduced into the toy. This is accomplished in a manner to be described.

The objects of the invention are to provide a magnetic toy in which the effect of a magnetic retaining plate is eliminated or substantially reduced when placing the particles on the base or picture plate and the magnetic retaining effect is restored whenever desired; also to provide a toy such that selected colors may be used in creating or embellishing a picture; further, to easily separate the colors after use; and, to provide a toy in which the screening means for separating the particles of different sizes is a unitary part of the toy.

Other objects of the invention will be more apparent from the following description when taken in connection with the accompanying drawings which illustrate preferred embodiments thereof, in which.

Figure 1:
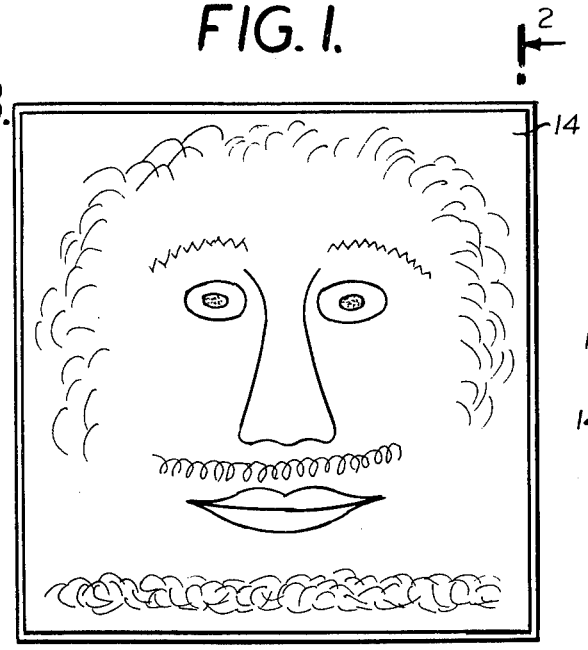
FIG. 1 is a plan view of one form of toy.
Figure 2:
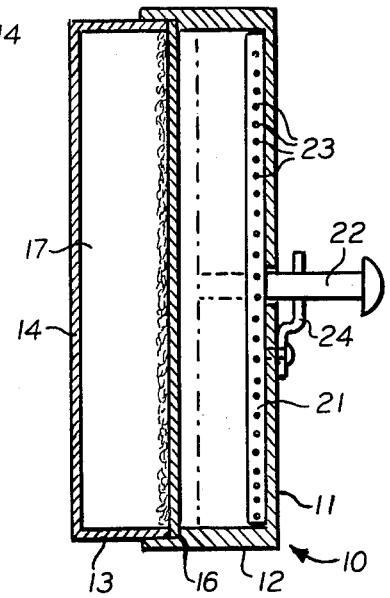
FIG. 2 is a section taken on line 2—2 of FIG. 1.
Figure 3:
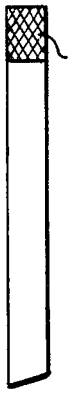
FIG. 3 shows an operating magnet or stylus.
Figure 5:
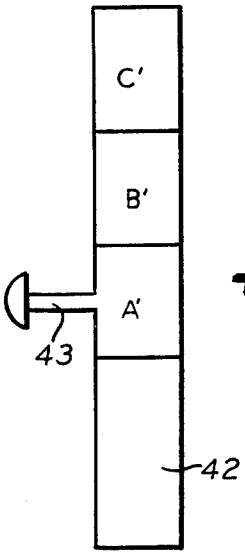
FIG. 5 is a section taken on line 5—5 of FIG. 4.
Figure 4:
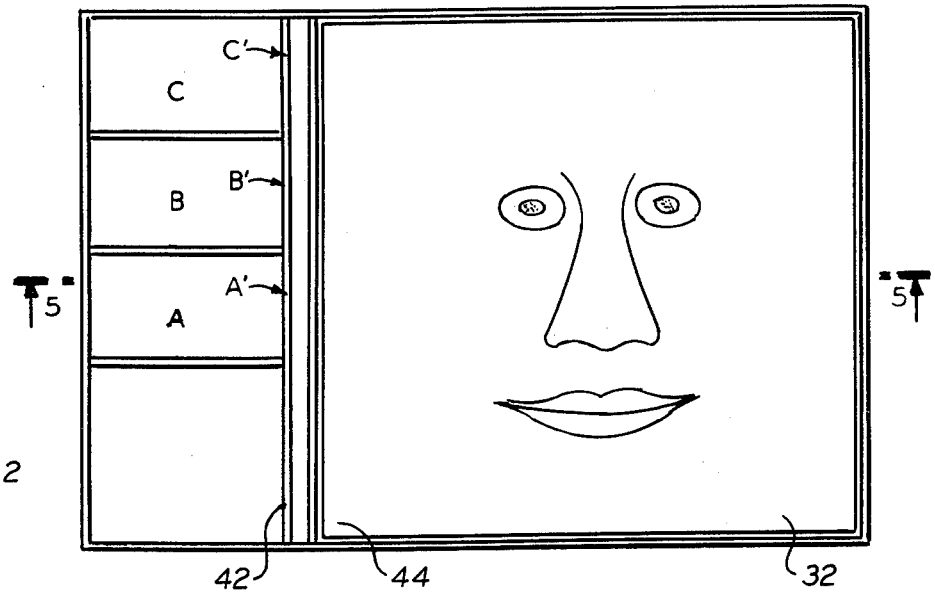
FIG. 4 shows a modified construction of the toy with the cover removed and also a toy using colored particles.
Figure 6:
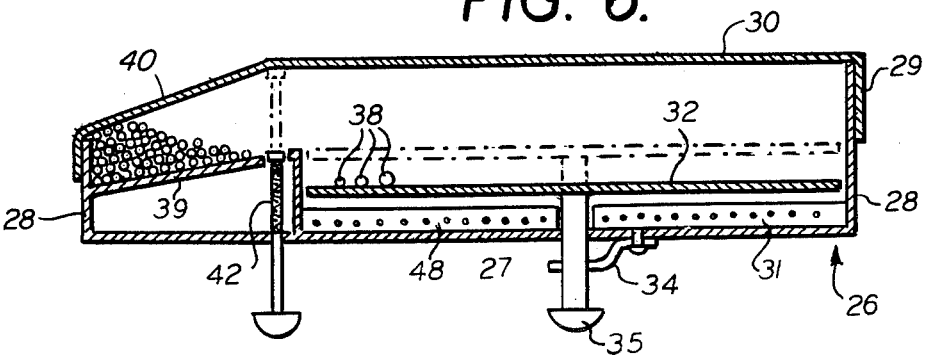
FIG. 6 is a view of a particle separating screen.

The toy in the form shown in FIGS. 1 and 2 has an enclosing case which includes a box 10 having a bottom 11, sides 12 and an open top. A transparent or translucent cover 14 is received over the open top which cover has a top 14. A base or picture plate 15 is provided in the box spaced from the bottom 11 such as by resting on a ledge 16 formed by the sides. The base plate may have a picture thereon to be embellished by magnetic particles 17 or the particles may be used to create a complete picture. The particles may take one of several forms such as iron filings, pellets, small scales and the like. The top 14 of the cover is spaced from the base plate such that the particles can be moved over the base plate or lifted to the inner surface of the cover 30 and then moved by the attraction of the magnet or stylus 18 above a desired position, FIG. 3. When a particle or particles are in a desired position on the base plate or above the desired position thereon, the magnet is raised from the cover and the particle remains in position or falls to its desired position.

When the particles 17 have been placed where desired on the base plate, a magnetic retaining or anchor plate 21, which is at the bottom of the box is raised by suitable means, such as the pin 22, so that it is in contact with the underside of the base plate or adjacent thereto so that the particals are retained in position by its attraction and are not inadvertently displaced. The magnetic plate has an area which is co-extensive with the display or picture area of the base plate.

A variation of and a more complex form of the invention is illustrated in FIGS. 4 to 7 which includes a box 26 having a bottom 27, side walls 28 and an open top. A transparent or translucent cover 29 is received over the top opening of the box and has a top 30. A magnetic retaining or anchor plate 31 is located and fixed at the bottom 27 of the box. In this construction a base plate 32 is movable towards and away from the magnetic plate to and from an operating position shown in dot-dash lines. The means for movably mounting and moving the base plate is shown as a pin 33 secured to the base plate and passing through a hole in the magnetic plate and a hole in the bottom 27 of the box. The base plate is suitably held in raised position, such as by a pivoted lock lever 33 which can be pivoted under the end or head of pin 33.

The box has a plurality of particle or pellet bins A, B and C at one side or edge to store the particles 38 which bins are on a level with the raised or operating position of the base plate. Desirably the bottoms of the bins incline downwardly from the base plate level which enables the bins to store a larger quantity of pellets. Preferably too the portion 40 of the top 30 of the cover inclines downwardly and to a greater degree than bottom 39 so that the magnet is nearer the pellets and can more easily pick up or move the pellets and move them over the base plate.

The particles 38 are round pellets of at least two different sizes or diameters and a bin is provided for each diameter, there being three bins shown one for each of the three different sizes of pellets. One size of pellet is one color and pellets of different diameters are a different color so that the picture created or decorated may have a choice of a plurality of colors. With pellets of three different diameters each of a different color provides three colors to choose from.

When it is desired to create a new picture or a new embellishment of a partial picture the pellets can be sorted as to size and hence color with a screening means comprising two screens for a toy having three diameters of pellets with one screen having screening apertures for the smallest size and a second screen having suitable apertures to pass pellets of the second or next size. The third or largest size needs no screen since the smaller sizes have been sorted or separated therefrom, although one could be provided. The screening of the sizes can be done away from the box by a separate screening means and the sorted pellets poured into its respective bin. It is more convenient to have the screening means form a part of the box and such screening means 42 is provided which is normally depressed in the position shown so that it is out of the way and does not interfere with the movement of pellets from the bins to the base plate. When it is desired to create or embellish a new picture, the screening means is raised by means of the pin 43 secured thereto to a position over the open ends of the bins. For a toy having three sizes of pellets, screen A′ has apertures to pass the smallest pellets and screen B′ passes the next larger size of pellet B. When the screen means is raised, screen A′ is over the open end of its bin A and screen B′ is over the open end of its bin B. The largest size of pellets remain and needs no screening and an opening is all that is needed to pass these pellets into their bin C although a screen C′ may be provided if desired. The screening means has then at least a screen for the number of pellet sizes provided less one. To sort the pellets the screen means is raised, the box tilted on edge so that the pellets collect in the corner 44. The box is then tilted so that the pellets roll over the screen means and each size of pellet drops into its bins. The box is now returned to horizontal, the screen means is lowered and the toy is ready for a second picture. The toy may be constructed for two different sizes or diameters of pellets or the three sizes illustrated or more different diameters and hence a greater number of colors. A similar lock means or lever 34 may be used to hold the screening means in screening position.

Figure 7:
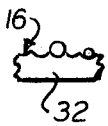
FIG. 7 is an enlarged partial section of a base plate.

With the particles being round pellets, it is desirable that the surface of the base plate have slight depressions 46, FIG. 7, so that the pellets will not inadvertently roll out of position.

The magnetic or retaining plate 31 is a known material of insulating material, such as plastic, with parallel wires 48 spaced a short distance apart carried thereby and shown as embedded in the plastic. Each wire is magnetized with alternate wires being of opposite polarity.

It is clear that each base plate 15 and 32 may be plain for creation of a complete picture or may have a partial picture to be embellished. The toy is more interesting if the base plate is plain with a variety of various partial pictures which can be placed thereon for embellishment. These pictures can be of infinite variety such as faces which may be attractive or comic and scenes of all sorts.

This invention fills a need for improvements in a magnetic toy with magnetic retaining means for retaining the particles in place. Various modifications thereof may and often do occur to those skilled in the art, especially after benefiting from the teachings herein. The preferred means of embodying the invention in useful form is illustrated and disclosed.

What is claimed is:

1. A toy adapted to be used with a magnet or stylus comprising a box, a base plate within the box and having an operative position, the base plate having a relatively flat upper surface with an operating area and a bottom surface, a transparent cover for the box spaced from the base plate when in operative position a distance approximating the limit of the magnetic attraction of the magnet, a plurality of magnetizable particles for use on the base plate, a magnetic plate having a dimension coextensive with the operating area and located beneath the base plate, one of said plates being fixed and the other plate being mounted for movement towards and away from the other, and means connected with the movable plate to move the same towards and away from the other plate to retain the particles in position on the base plate when the plates are together.

2. A toy as in claim 1 in which the magnetic plate is mounted for movement towards and away from the base plate.

3. A toy as in claim 1 in which the particles are round pellets, and the surface of the operating area of the base plate is dented sufficiently to prevent inadvertent rolling of the pellets thereon.

4. A toy as in claim 3 in which the round pellets are of at least two diferent diameters.

5. A toy as in claim 4 in which the pellets of one diameter are one color and the pellets of each different diameter are a different color.

6. A toy as in claim 4 including a pellet bin for each size of pellet adjacent to the base plate, and screening means including a screen for each size of pellet for the smaller sized pellet or pellets to separate each size into its respective bin.

7. A toy adapted to be used with a magnet or stylus comprising a box, a base plate within the box and having an operative position, the base plate having a relatively flat upper surface with an operating area and a bottom surface, a transparent cover for the box over at least the operating area of the base plate and spaced from the base plate when in operative position a distance approximating the limit of the magnetic attraction of the magnet, and a plurality of magnetizable particles of at least two sizes.

8. A toy as in claim 7 in which the particles are round pellets and each size being of a different color.

9. A toy as in claim 7 including screening means to separate each sized particle from the particles of another size or sizes.

10. A toy as in claim 8 in which the box has a pellet bin for each size of pellet at a side edge thereof, screening means including a screen for at least each size of pellet less one, and means mounting the screening means for movement to and from a position in front of its respective bin.

11. A toy as in claim 10 in which the pellet bins are at one side of the box, and the screening means includes the screens connected together as a unit.

12. A toy as in claim 10 in which the cover slants down over the pellet bins.

13. A toy as in claim 1 in which the base plate is movably mounted for movement towards and away from the magnetic plate with an operative position spaced from the magnetic plate, and means to move the base plate.

14. A toy as in claim 13 in which the particles are round pellets of at least one diameter.

15. A toy as in claim 14 in which the operating surface of the base plate is dented sufficiently to prevent inadvertent rolling of the pellets thereon.

16. A toy as in claim 15 in which the round pellets are of at least two different diameters.

17. A toy as in claim 16 in which the pellets of one diameter are one color and the pellets of a different diameter are a different color.

18. A toy as in claim 17 including a pellet bin for each diameter of pellet adjacent to the base plate at operating position and having an open end, screening means including a screen for at least the smaller diameter or diameters of pellets, means movably mounting the screening means for movement over and away from the open end of the bin or bins, and means connected with screening means to move the same.

* * * * *